United States Patent [19]

Harman

[11] 4,156,521

[45] May 29, 1979

[54] HOIST WITH LOAD BRAKE HAVING RELEASE MECHANISM THEREFOR

[75] Inventor: James R. Harman, West Memphis, Ark.

[73] Assignee: Eaton Corporation, Cleveland, Ohio

[21] Appl. No.: 798,741

[22] Filed: May 19, 1977

[51] Int. Cl.[2] ..... B66D 1/00

[52] U.S. Cl. ..... 254/167; 192/16; 188/82.9

[58] Field of Search ..... 254/167, 169, 186 HC, 254/149; 192/16, 8 R; 188/82.9, 82.1

[56] References Cited

U.S. PATENT DOCUMENTS

| | | | |
|---|---|---|---|
| 3,047,114 | 7/1962 | Stevens, Jr. | 254/167 |
| 3,182,962 | 5/1967 | Gray | 254/167 |
| 3,626,499 | 12/1971 | Iwama et al. | 254/167 |
| 3,776,514 | 12/1973 | Eggleton, Jr. et al. | 254/167 |
| 3,897,678 | 8/1975 | Zurek et al. | 192/16 |

*Primary Examiner*—Joseph J. Rolla
*Assistant Examiner*—Kenneth W. Noland
*Attorney, Agent, or Firm*—R. J. McCloskey; D. Wood; G. L. Lewis

[57] ABSTRACT

A hoist of the type including a Weston-type load brake actuated by relative rotary movement between a pair of input drive members and having a control mechanism actuated by plunger carried within the hoist to allow or prevent axial movement of the input drive members from the position wherein their relative rotary movement actuates the load brake.

7 Claims, 4 Drawing Figures

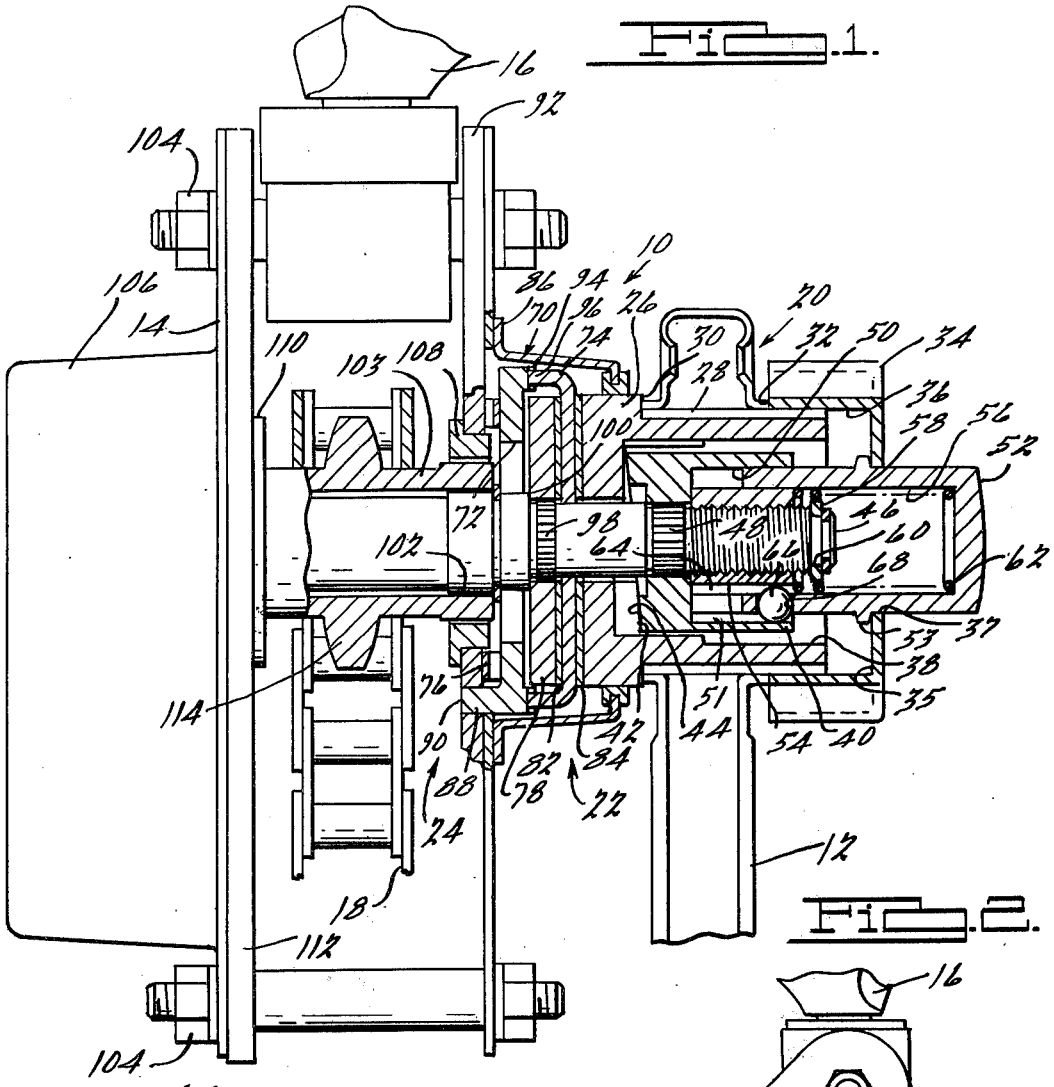
FIG. 1.
FIG. 2.
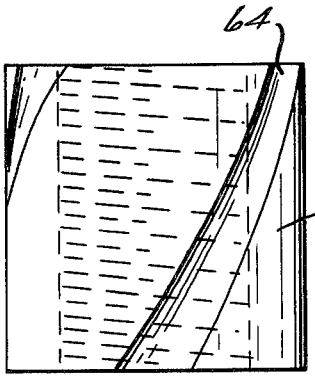
FIG. 3.
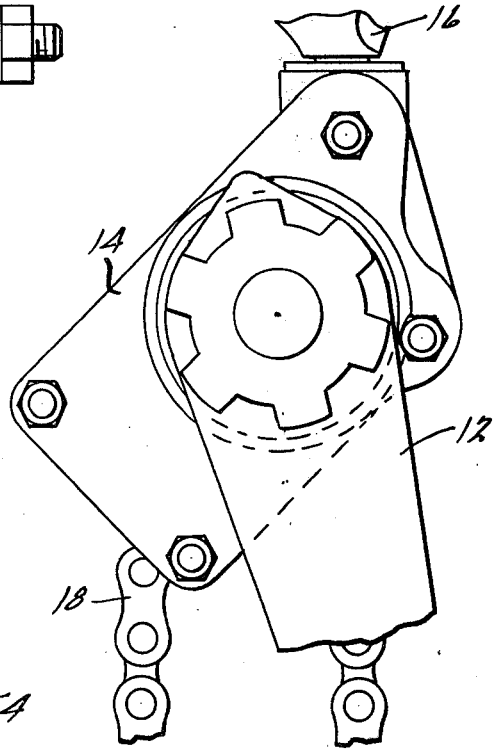
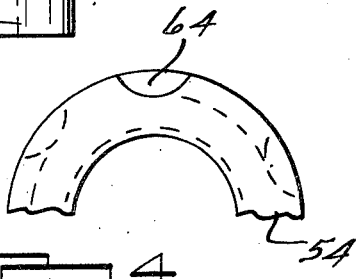
FIG. 4.

HOIST WITH LOAD BRAKE HAVING RELEASE MECHANISM THEREFOR

BACKGROUND OF THE INVENTION

1. Field of the Invention

The present invention relates generally to hoists, more particularly to hoists employing Weston-type load brakes, and most particularly to the provision of release mechanisms for such load brakes.

2. Description of the Prior Art

In the hoisting equipment industry, it is well known to provide Weston-type load brakes to hold a load during relaxation of the input force used to move the load. In a manually operated hoist, it is common to actuate the load brake through relative movement of a pair of rotatable input drive members, one of which drivingly engages a source of input force and the other of which engages a drive portion of the hoist. Problems in the use of such hoists are encountered when the hoist completes its lifting or lowering operation and the load is removed. The load brake maintains its engaged condition until a reverse torque is applied to the input drive members or until the mechanism is shock loaded to break its static frictional engagement effected by the input drive members during operation.

The former disengagement method is often impractical where the hoist is of the type suspended from a support during operation since there is nothing to restrain its motion responsive to reverse rotation in the absence of a load.

The latter method has the disadvantage of lacking control of input forces to the hoist which may result in overloading of parts of the hoist and damage thereto.

SUMMARY OF THE INVENTION

Responsive to the disadvantages of the prior art hoists, it is an object of the present invention to provide a hoist including a load brake wherein means are provided in the hoist for controlling the engagement and disengagement of the load brake.

It is a further object of the invention to provide a hoist including means for minimizing the forces applied to the hoist in unlocking a frictionally locked load brake.

According to one feature of the invention, a retaining member is provided which is moveable along a threaded input shaft of a hoist in response to the axial movement of an associated plunger to allow or prevent movement of the hoist input drive members from a position in which the load brake may be frictionally locked.

BRIEF DESCRIPTION OF THE DRAWING

These and other objects and features will become apparent to those skilled in the hoisting equipment art upon reading the accompanying description and drawing in which:

FIG. 1 is a cross sectional view of the hoist of the present invention;

FIG. 2 is a side elevational view of the hoist of the present invention;

FIG. 3 is an enlarged elevational view of the retaining nut of the hoist of the present invention; and FIG. 4 is a partial sectional view taken along line 4—4 of FIG. 3.

DESCRIPTION OF THE PREFERRED EMBODIMENT

Referring now to the drawings and particularly to FIG. 2, a hoist 10 is illustrated as generally being of the type including an input drive lever 12 mounted for rotation about an axis extending through a housing 14. A hook 16 (partially shown) is secured to the housing 14 to facilitate attachment to a supporting structure (not shown), and operation of the input drive lever 12 is effective to move a chain 18 to draw or release a load through attachment means (not shown). The general arrangement of lever, hook, and chain depicted is described for illustrative purposes only and forms no part of the present invention, as will be clear to those skilled in the art as the description progresses.

Referring now to FIG. 1, the hoist 10 includes an input section 20, a load brake section 22, and an output section 24. The input section 20 includes the input drive lever 12 which is preferably drivingly connected through a known pawl mechanism (not shown) to an input drive hub 26 which includes radially outwardly disposed ratchet teeth 28 for cooperation with the pawl mechanism. The input lever 12 is axially retained between an annular shoulder 30 formed on the input drive hub 26 and the inner face 32 of a handwheel 34. Handwheel 34 includes a first bore 36 sized to receive the outward facing end of the input drive hub 26.

Input hub member 26 includes an inward extending stepped bore 38 for receiving a cam member 40 and annular cooperating cam surfaces 42, 44 are formed on the hub member 26 and cam member 40, respectively. The cam member 40 is drivingly connected to an input drive shaft 46, preferably through a spline connection as indicated at 48, and includes a central bore 50 for slidingly receiving the open end of a generally cup-shaped plunger 52.

A retaining member such as nut 54 is threadedly received on the shaft 46 for axially positioning the cam member 40 and is slidingly received in a bore 56 in the plunger 52. A retainer 58 is received in a groove 60 formed in the outer diameter of the shaft 46 for preventing outward removal of the nut 54, and a compression spring 62 is grounded between the nut 54 and the plunger 52. The closed end of plunger 52 is received in a second bore 37 in handwheel 34 and an annular shoulder 53 abuts an inner wall 35 thereof to prevent outward removal.

As may best be seen in FIGS. 3 and 4, the nut 54 has a plurality of helically formed grooves 64 preferably formed in semicircular cross section in its outer surface. These are for receiving a corresponding number of balls 66 (one shown in FIG. 2) which are received in transverse through holes 68 of plunger 52 and which are also received in axially extending slots 51 formed of preferably semicircular cross section in the cam member 40.

Turning now in more detail to the load brake section 22, it is illustrated as a Weston-type brake mechanism including a ratchet assembly 70 which comprises a ratchet disc 72, a ratchet cup 74, and a load spring 76; a reaction plate 78; friction discs 82, 84; and a cover 86 fixed to the housing 14, and the hub 26.

The ratchet disc 72 is secured against rotation with respect to the housing 14 by a plurality of feet 88 (one shown) slidingly received in corresponding apertures 90 in a side plate 92 of the housing 14. It is urged outward (rightward in FIG. 1) by the spring 76 (preferably a wave washer) disposed intermediate the disc 72 and the side plate 92. It includes annularly arrayed ratchet teeth 94 which engage mating teeth 96 of the ratchet cup 74, which is piloted on the shaft 46.

The reaction plate 78 is spline connected to the input drive shaft 46 at 98 and is assembled to abut a shoulder 100 formed on the shaft 46. Friction discs 82, 84 are interdigitated between the reaction plate 78 and the ratchet cup 74 and between the ratchet cup 74 and the input drive hub 26.

Proceeding now to the output section 24, the gear shaft 46 is journalled at 102 in output shaft 103 illustrated as a sprocket and by bearing (not shown) in a cover plate 106 of the housing 14. The shaft 46 drivingly engages a reduction gear set (not shown) to drive the output shaft 103, which is simply supported for rotation by a pair of bearings 108, 110 mounted in side plates 92, 112 respectively. The side plates 92, 112 and the cover 106 are fastened in spaced apart relationship by suitable fasteners 104. In the preferred embodiment, teeth 114 of output shaft 103 engage the chain 18 to draw or release a load.

OPERATION OF THE PREFERRED EMBODIMENT

In raising a load with the invention hoist 10, the pawl mechanism is engaged in one direction and the input lever 12 is moved pivotally with respect to the housing 14 to drivingly engage and rotate the input drive hub 26. As the hub 26 rotates with respect to the cam member 40, the sliding engagement of the abutting cam surfaces 42, 44 effects inward movement of hub 26 thereby axially loading the friction discs 82, 84 against the reaction plate 78 and the ratchet cup 74. Since the reaction plate 78 abuts the shoulder 100 of gear shaft 46, a frictional driving connection is effected and the gear shaft 46 is turned while the cup 74 is ratchetly disengaged from the ratchet disc 72. This effects movement of the reduction gearing to move the output shaft 103 against the load. Reverse pivotal movement of the lever 12 ratchetly disengages the pawl mechanism from the input drive hub 26. The ratchet assembly 70 of the load brake section 22, however, engages to frictionally lock the input drive shaft 46 to the housing 14 to support the load. Lowering a load can be accomplished in a conventional manner by reversing the input motion. Further discussion of this operation is unnecessary, though, for an understanding of the present invention.

The profile of the cam surfaces 42, 44 and their coefficients of friction are chosen to make the assembly self-locking upon imposition of the load. Relieving the load after lifting or lowering, then, even if accomplished abruptly, will not unlock the load brake. In this respect, as well as in the described lifting or lowering operations, the invention hoist 10 does not differ from hoists of the prior art.

It is in releasing the load brake that the invention hoist 10 advantageously differs from previous devices. When a hoist is in the load-removed and locked condition described, it has heretofore been the practice to release the load brakes through either reversing the torque input to the hoist or through shock loading the hoist parallel to the load brake axis. This former method is often unpractical due to the difficulty of rotatively restraining the unloaded hoist body. The latter method is potentially damaging since the imposition of the shock load is virtually uncontrolled.

In the hoist 10 of the present invention, the torque reversal method is, of course, still possible, but provisions are also made for controlling engagement and a safe, controlled release of the load brake through imposition of force parallel to the axis of the input drive shaft 46.

This is accomplished by loading the plunger 52 inward, preferably through impacting its outer end. Inward movement of the plunger 52 directs the movement of the balls 66 along the axially extending slots 51 of cam member 50 which is splined to the locked shaft 46. Concurrently, the inward movement of the balls 66 coacts with the helical grooves 64 of the nut 54 in which they are also received to rotate the nut 54 in the releasing direction, i.e., effecting its outward movement. This, of course, permits free axial movement of the cam member 50 on the shaft 46, thereby releasing the load brake. When the inward force is removed from the end of the plunger 52, the spring 62 operates to return the plunger 52 to the illustrated outward position abutting the inner surface 35 of handwheel 34. In returning to this position, the balls 66 are again carried along the axially extended slots 51 and act upon the helical grooves 64 to return the nut 54 to its original position restraining outward movement of the cam member 50 when a lifting or lowering operation is repeated.

While only one embodiment of the invention hoist has been disclosed, others are possible without departing from the scope of the appended claims.

What is claimed is:

1. A hoist of the type adapted to be supported for drawing and releasing a load, the hoist comprising:

A. A housing;

B. output drive means carried for rotation in said housing;

C. an output shaft operatively connected to said output drive means;

D. first and second rotatable input drive members arranged concentric with the axis of said input shaft and operative to transmit torque to said input shaft;

E. load brake means disposed intermediate said housing and said input drive members and operative upon imposition of a locking force parallel to said axis to create a frictional locking force between said housing, said input shaft and one of said input drive members to prevent movement of said load against the rotation of said input drive members;

F. means operative to the occurrence of relative rotation of said input drive members in one direction to effect axial movement of said one input drive member to impose said locking force;

G. load brake control means operative to prevent or allow axial movement of the other input drive member from a position wherein said locking force is imposed and including:

1. retaining means threadedly received on said input shaft and axially moveable by rotation between a locked position wherein such axial movement of said other member is prevented and an unlocked position wherein such axial movement of said other member is allowed; and 2. linearly moveable actuator means operative in response to the imposition of a force thereon parallel to the axis of said input shaft to rotate said retaining means to effect axial movement thereof between said locked and unlocked positions;

H. said other input drive member comprises a generally cup-shaped cam member drivingly engaging said input shaft and having an inner peripheral surface extending axially outward away from said housing;

I. said retaining means includes a generally cylindrical portion defining the outer peripheral surface spaced radially inward from said cam member inner peripheral surface and extending axially outward away from said housing;

J. said actuator means comprises:

1. generally cup-shaped plunger means including an annular cylindrical portion extending axially inward and disposed intermediate said peripheral surfaces; and
2. force transmitting means operative to effect rotation of said retaining means upon the imposition of a force effecting axial displacement of said plunger means.

2. A hoist as defined in claim 1, wherein said force transmitting means comprises:

A. a plurality of axially extending grooves of semicircular cross-section formed in one of said peripheral surfaces;

B. a plurality of helically extending grooves of semicircular cross-section formed in the other of said peripheral surfaces;

C. a plurality of apertures extending radially outward through said plunger means cylindrical portion; and D. a plurality of balls each received in one of said apertures and engaging one of said axially extending slots and one of said helically extending slots.

3. A hoist as defined in claim 1, wherein said force transmitting means comprises:

A. a plurality of axially extending grooves of semicircular cross-section formed in said cam member peripheral surface;

B. a plurality of helically extending grooves of semicircular cross-section formed in said retaining member peripheral surface;

C. a plurality of apertures extending outward through said plunger cylindrical portion; and D. a plurality of balls each received in one of said apertures and engaging one of said axially extending slots and one of said helically extending grooves.

4. A hoist of the type adapted to be suspended from a support for drawing and releasing a load, the hoist comprising:

A. a housing;

B. output drive means mounted for rotation in said housing and including means for engaging said load;

C. an input shaft operatively connected to said output drive means;

D. an input hub mounted for rotation about the axis of said input shaft and including an annular cam surface;

E. load brake means including reaction means abuttingly engageable with a portion of said input shaft and drivingly engaged thereto and friction means disposed between said reaction means, said housing, and said input hub;

F. a generally cup-shaped cam member drivingly engaging said input shaft and including an annular cam surface drivingly engageable with said input hub member cam surface;

G. a retaining member threadedly received in the open end of said cam member through rotation in one direction on said input shaft to an axial position abutting said cam member wherein relative movement of said input hub member in one direction with respect to said cam member effects axial movement of said hub member through said cam surfaces to create a frictional locking force between said hub member, said housing, said friction means, and said reaction means; and H. means responsive to imposition of a force parallel to the axis of said input shaft to rotate said retaining nut in the other direction and thereby release said frictional locking force, said force responsive means comprising:

1. plunger means, including an annular portion, slidably received in said cam member open end radially intermediate said cam member and said retaining member;
2. a plurality of axially extending grooves formed in one of said members;
3. a plurality of helically extending grooves formed in the other of said members; and
4. force transmitting means carried with said plunger means and operatively engaging such of said grooves whereby axial movement of said plunger means with respect to said members effects rotation of said retaining member.

5. A hoist as defined in claim 4, wherein said force transmitting means comprises a plurality of apertures extending radially through said plunger annular portion and a plurality of balls, each rotatably received in said apertures and engaging one of said axially extending grooves and one of said helically extending grooves.

6. A hoist as defined in claim 4, wherein said axially extending grooves are formed in the inner periphery of said cam member open end.

7. A hoist as defined in claim 6, wherein said force transmitting means comprises a plurality of apertures extending radially through said plunger annular portion and a plurality of balls, each rotatably received in said apertures and engaging one of said axially extending grooves and one of said helically extending grooves.

* * * * *